US006071104A

United States Patent [19]

Sakimoto et al.

[11] Patent Number: 6,071,104

[45] Date of Patent: Jun. 6, 2000

[54] CLOSED COMPRESSOR HAVING MEANS FOR SATISFACTORILY LUBRICATING COMPRESSION MECHANISM

[75] Inventors: Takamasa Sakimoto; Shigeru Muramatsu, both of Kusatsu, Japan

[73] Assignee: Matsushita Electric Industrial Co., Ltd., Osaka-Fu, Japan

[21] Appl. No.: 08/923,422

[22] Filed: Sep. 4, 1997

[30] Foreign Application Priority Data

Sep. 6, 1996 [JP] Japan ..... 8-236326

[51] Int. Cl.[7] ..... F04C 29/02; F01M 1/00

[52] U.S. Cl. ..... 418/94; 184/6.18

[58] Field of Search ..... 418/94, 96; 184/6.16, 184/6.18

[56] References Cited

U.S. PATENT DOCUMENTS

| | | | |
|---|---|---|---|
| 4,565,503 | 1/1986 | Wise | 184/6.16 |
| 4,585,403 | 4/1986 | Inaba et al. | 418/94 |
| 4,915,554 | 4/1990 | Serizawa et al. | 418/94 |

FOREIGN PATENT DOCUMENTS

| | | | |
|---|---|---|---|
| 61-40482 | 2/1986 | Japan | 418/94 |
| 61-112795 | 5/1986 | Japan | 418/94 |
| 62-199991 | 9/1987 | Japan | 418/94 |

*Primary Examiner*—John J. Vrablik

*Attorney, Agent, or Firm*—Wenderoth, Lind & Ponack, L.L.P.

[57] ABSTRACT

A closed compressor includes a closed vessel having an oil sump in which lubricating oil which is incompatible with a refrigerant is accommodated. A compression mechanism, to which a rotary shaft is connected, is accommodated in the closed vessel. An electric motor is also accommodated in the closed vessel for rotating the rotary shaft to drive the compression mechanism. An oil supply pipe is secured to a lower end of the rotary shaft to draw the lubricating oil contained in the oil sump to the compression mechanism. A generally cylindrical partition wall is formed in the oil sump so as to encircle the oil supply pipe and has a plurality of holes to allow the lubricating oil to pass therethrough. The generally cylindrical partition wall may be replaced with a partition wall that laterally partitions the oil sump into two portions. It is preferred that the plurality of holes includes at least vertically spaced first and second rows of holes with the first row being positioned above the second row. Each hole of the first row has an area greater than the holes of the second row.

7 Claims, 7 Drawing Sheets

CLOSED COMPRESSOR HAVING MEANS FOR SATISFACTORILY LUBRICATING COMPRESSION MECHANISM

BACKGROUND OF THE INVENTION

1. Field of the Invention

The present invention relates to a closed compressor accommodating lubricating oil which is incompatible with a refrigerant.

2. Description of Related Art

FIG. 8 depicts a conventional compressor comprising a compression mechanism 1, a rotary shaft 2 connected to the compression mechanism 1, an electric motor 3 for rotating the rotary shaft 2 to drive the compression mechanism 1, and a closed vessel 4 in which the compression mechanism 1, the rotary shaft 2 and the electric motor 3 are accommodated. The closed vessel 4 also accommodates lubricating oil 5 stored at a bottom portion thereof. The rotary shaft 2 has an oil supply pipe 6 secured to a lower end thereof to introduce the lubricating oil 5 to the compression mechanism 1.

In use, when the electric motor 3 rotates the rotary shaft 2 together with the oil supply pipe 6, the oil supply pipe 6 draws up the lubricating oil 5 stored at the bottom portion of the closed vessel 4 so that the compression mechanism 1 is lubricated. The lubricating oil 5 takes heat from the compression mechanism 1 and the electric motor 3 and then heat-exchanges with the closed vessel 4, which in turn radiates heat to the outside air.

In the above-described construction, however, if the lubricating oil 5 is incompatible with a refrigerant, a liquid refrigerant is accumulated in the bottom portion of the closed vessel 4. In general, the lubricating oil 5 and the liquid refrigerant 7 so accumulated in the bottom portion are separated into two phases. In this case, it is likely that the liquid refrigerant 7 having a specific gravity greater than the lubricating oil 5 and, thus, sitting below the lubricating oil 5 would be introduced into the compression mechanism 1 through the oil supply pipe 6. Consequently, the lubricating action to the compression mechanism 1 is lowered, the wear of the compression mechanism 1 is accelerated, and a temperature rise of the electric motor 3 is brought about. As a result, the reliability of the closed compressor is lowered. This phenomenon becomes conspicuous, particularly when the liquid refrigerant is returned back into the compressor during operation.

SUMMARY OF THE INVENTION

The present invention has been developed to overcome the above-described disadvantages.

It is accordingly an objective of the present invention to provide a closed compressor having a means for satisfactorily lubricating a compression mechanism.

In accomplishing the above and other objectives, the closed compressor of the present invention comprises a closed vessel having an oil sump defined therein in which lubricating oil incompatible with a refrigerant is accommodated. A compression mechanism is accommodated in the closed vessel, and a rotary shaft is connected to the compression mechanism. An electric motor is provided for rotating the rotary shaft to drive the compression mechanism, and an oil supply pipe is secured to one end of the rotary shaft to draw the lubricating oil contained in the oil sump to the compression mechanism. A generally cylindrical partition wall encircling the oil supply pipe and having a plurality of holes defined therein is provided to allow the lubricating oil to pass therethrough.

By the above-described construction, even if a liquid refrigerant is returned to the closed vessel during operation of the compressor, the liquid refrigerant is first accumulated outside the generally cylindrical partition wall. Accordingly, the partition wall prevents the liquid refrigerant from being introduced into the oil supply pipe until the level of the liquid refrigerant reaches the lowermost holes.

Advantageously, the plurality of holes include at least vertically spaced first and second rows of holes, with the first row being positioned above the second row, and each hole of the first row has an area greater than each of the holes of the second row.

When the lubricating oil and the liquid refrigerant outside the generally cylindrical partition wall are separated into two phases, the lubricating oil is positioned above the liquid refrigerant because the former has a specific gravity smaller than the latter. Accordingly, a larger quantity of lubricating oil than liquid refrigerant is introduced inside the generally cylindrical partition wall and is supplied to the compression mechanism through the oil supply pipe.

In another aspect of the present invention, a closed compressor comprises a closed vessel having an oil sump defined therein in which lubricating oil which is incompatible with a refrigerant is accommodated. A compression mechanism is accommodated in the closed vessel, and a rotary shaft is connected to the compression mechanism. An electric motor is provided for rotating the rotary shaft to drive the compression mechanism, and an oil supply pipe is secured to one end of the rotary shaft to draw the lubricating oil contained in the oil sump to the compression mechanism. A partition wall is also provided for partitioning the oil sump into a first portion in which the oil supply pipe is positioned and a second portion. The partition wall has a plurality of holes defined therein to allow the lubricating oil to pass therethrough. Either the closed vessel or the compression mechanism has a refrigerant passage defined therein and positioned above the second portion of the oil sump.

In the above-described construction, the refrigerant passage is positioned above the second portion of the oil sump separated from the oil supply pipe by the partition wall. Therefore, even if a liquid refrigerant is returned to the closed vessel during operation of the compressor, the liquid refrigerant is first accumulated in the second portion of the oil sump. Accordingly, the partition wall prevents the liquid refrigerant from being introduced into the oil supply pipe until the level of the liquid refrigerant reaches the lowermost holes.

The closed compressor includes a main frame for rotatably supporting an orbiting element of the compression mechanism. The main frame has an oil return through-hole defined therein through which lubricating oil having lubricated the compression mechanism is returned to the oil sump. The oil return through-hole is positioned above the first portion of the oil sump. Because the oil supply pipe is positioned in the first portion of the oil sump, the lubricating oil having passed through the oil return through-hole is first accumulated in the first portion of the oil sump and then introduced to the compression mechanism through the oil supply pipe.

In a further aspect of the present invention, a closed compressor comprises a closed vessel having an oil sump defined therein in which lubricating oil which is incompatible with a refrigerant is accommodated. A compression mechanism is accommodated in the closed vessel, and a rotary shaft is connected to the compression mechanism. An electric motor is provided for rotating the rotary shaft to drive the compression mechanism, and an oil supply pipe is secured to one end of the rotary shaft to draw the lubricating oil contained in the oil sump to the compression mechanism. An agitating means is secured to the oil supply pipe for rotation therewith.

During operation of the compressor, the agitating means is driven by the electric motor to agitate both the lubricating oil and the liquid refrigerant contained in the oil sump, thereby producing a centrifugal force which acts on both the liquids. As a result, the liquid refrigerant having a specific gravity greater than the lubricating oil is pressed against the side wall of the closed vessel, while the lubricating oil is collected radially inward of the oil sump and drawn into the oil supply pipe. Accordingly, even when the liquid refrigerant is returned to the closed vessel during operation of the compressor, the compression mechanism is supplied with a sufficient amount of lubricating oil. Thus, the reliability of the compressor is enhanced.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

This application is based on an application No. 8-236326 filed in Japan, the content of which is incorporated herein by reference.

Figure 1:
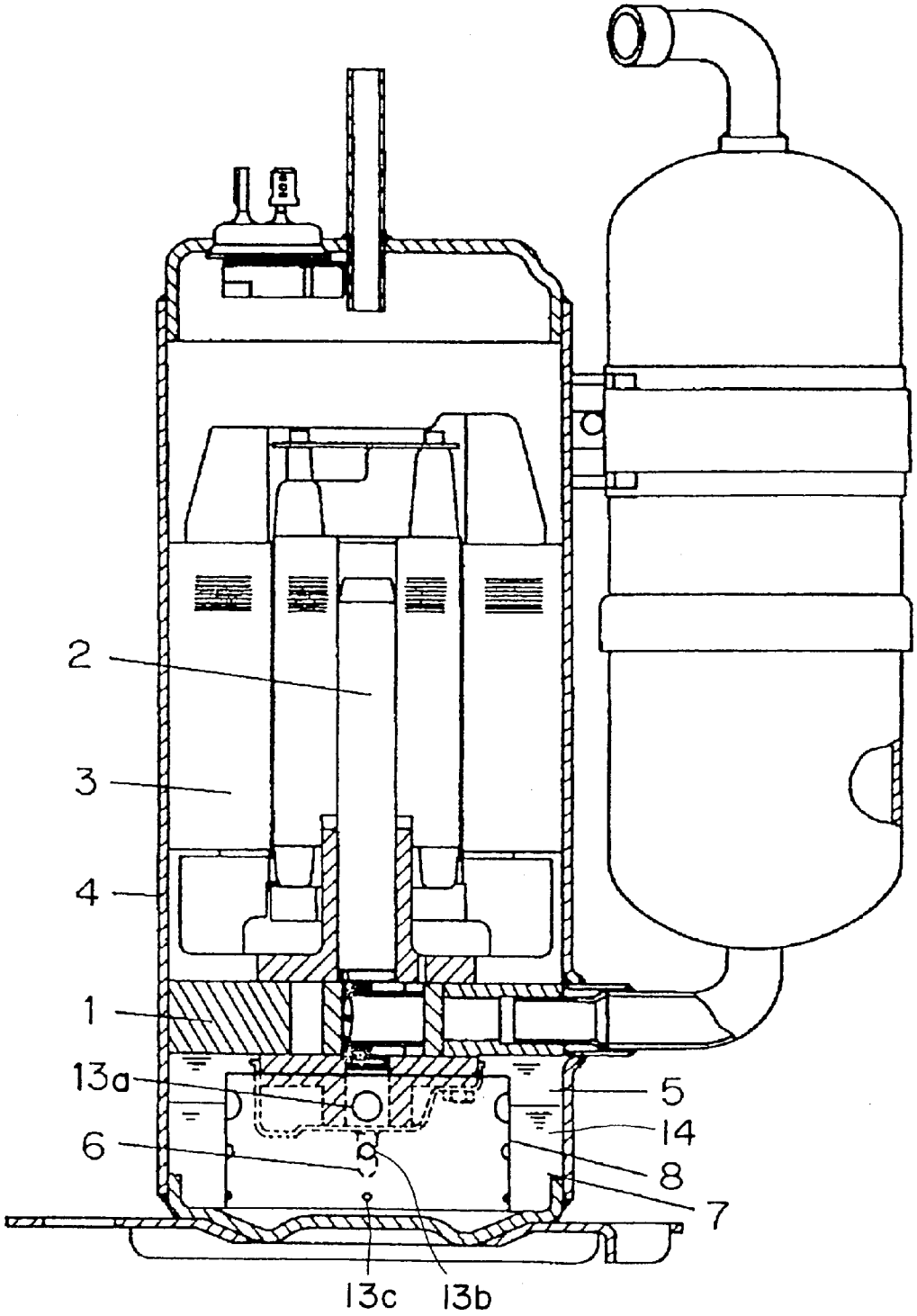
FIG. 1 is a sectional view of a closed compressor according to a first embodiment of the present invention.
Figure 2A:
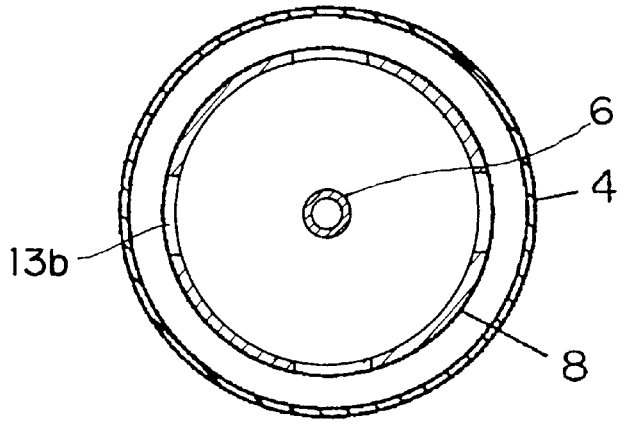
FIG. 2A is a top plan view of a lower portion of the closed compressor of FIG. 1, in which a generally cylindrical partition wall is provided.

Referring now to the drawings, there is shown in FIG. 1 a closed compressor according to a first embodiment of the present invention. The closed compressor shown therein comprises a compression mechanism 1, a rotary shaft 2 connected to the compression mechanism 1, an electric motor 3 having a stator and a rotor for rotating the rotary shaft 2 to drive the compression mechanism 1, and a closed vessel 4, in which the compression mechanism 1, the rotary shaft 2, and the electric motor 3 are accommodated. The closed vessel 4 has an oil sump 14 defined therein at a bottom portion thereof and also accommodates an oil supply pipe 6 secured to a lower end of the rotary shaft 2. A generally cylindrical partition wall 8 is fixedly mounted on or welded to a bottom plate of the closed vessel 4. The partition wall 8 encircles the oil supply pipe 6, as shown in FIG. 2A, and is intended to separate lubricating oil 5 from a liquid refrigerant 7.

Figure 2B:
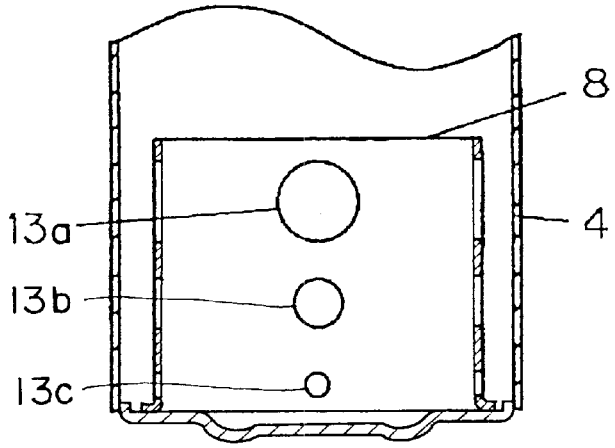
FIG. 2B is a partial section view of the lower portion of the closed compressor of FIG. 1.
Figure 2C:
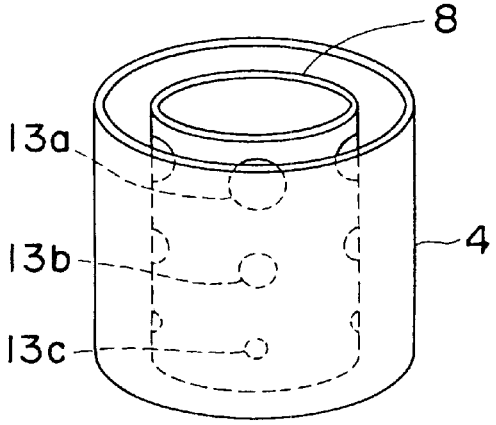
FIG. 2C is a perspective view of the lower portion of the closed compressor of FIG. 1.

As shown in. FIGS. 2B and 2C, the partition wall 8 has upper, intermediate and lower circumferential rows of generally round holes 13*a*, 13*b* and 13*c* defined therein with those circumferential rows being spaced from each other in an axial direction of the partition wall 8. Each of the round holes 13*a* of the upper row has a diameter greater than the round holes 13*b* of the intermediate row, while each of the round holes 13*c* of the lower row has a diameter smaller than the round holes 13*b* of the intermediate row.

In applications where the liquid refrigerant 7 and the lubricating oil 5 are both contained in the oil sump 14 in a mixed fashion, the lubricating oil 5 having a specific gravity smaller than the liquid refrigerant 7 is positioned at an upper portion of the oil sump 14. Accordingly, a larger quantity of lubricating oil 5 than liquid refrigerant 7 is introduced inside the partition wall 8 through the upper row of round holes 13*a* which have a larger area than the other rows of round holes 13*b* and 13*c*. The mixture including a larger quantity of lubricating oil is drawn up towards the compression mechanism 1 through the oil supply pipe 6, thus enhancing the reliability of the closed compressor.

Figure 3:
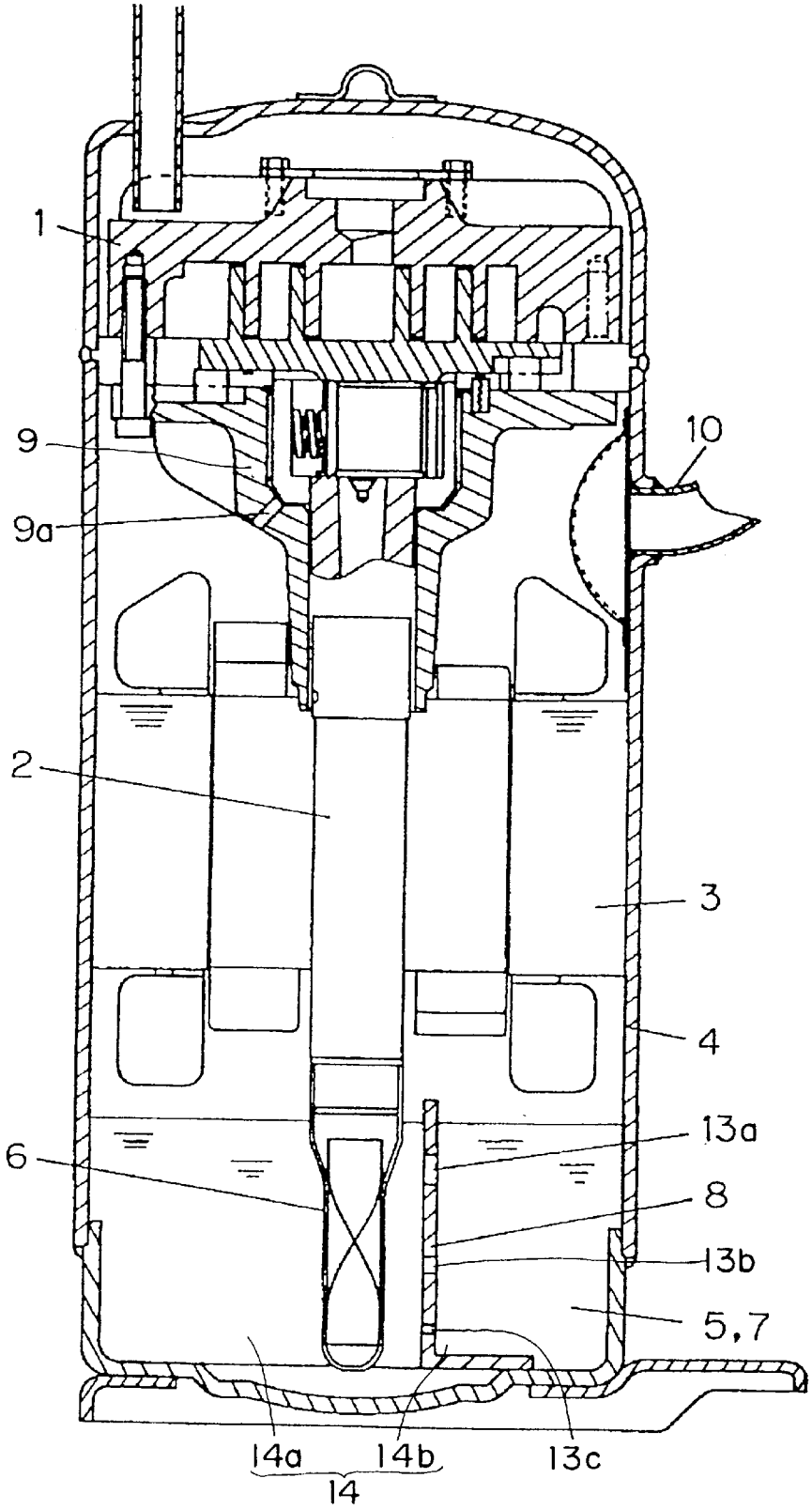
FIG. 3 is a sectional view of a closed compressor according to a second embodiment of the present invention.
Figure 4:
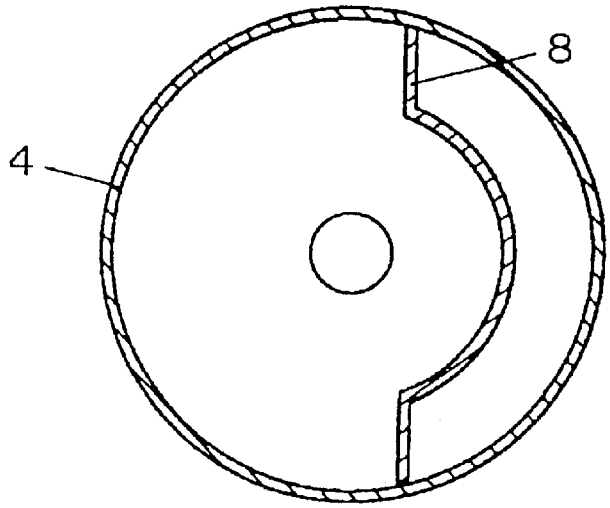
FIG. 4 is a top plan view similar to FIG. CA, but illustrating a partition wall provided in a lower portion of the closed compressor of FIG. 3.

FIG. 3 depicts a closed compressor according to a second embodiment of the present invention. As is the case with the closed compressor of FIG. 1, the closed compressor of FIG. 3 has a closed vessel 4 in which a compression mechanism 1, a rotary shaft 2, an electric motor 3 and the like are accommodated. The closed vessel 4 also accommodates a main frame 9 for rotatably supporting an orbiting element of the compression mechanism 1. The main frame 9 has at least one oil return through-hole 9*a* defined therein through which lubricating oil 5 having lubricated the compression mechanism 1 is returned to an oil sump 14 formed at a bottom portion of the closed vessel 4. The closed compressor of FIG. 3 includes an oil supply pipe 6 secured to a lower end of the rotary shaft 2, a partition wall 8 secured to the bottom and side walls of the closed vessel 4, as shown in FIGS. 3 and 4, and a refrigerant suction pipe 10 secured to a side wall of the closed vessel 4 so as to extend therethrough. The oil sump 14 is partitioned by the partition wall 8 into a first oil sump 14*a* and a second oil sump 14*b*. The oil supply pipe 6 is positioned within the first oil sump 14*a* and the oil return through-hole 9*a* is positioned above the first oil sump 14*a*, while an open end of the refrigerant suction pipe 10 is positioned above the second oil sump 14*b*. The suction pressure acts within the closed vessel 4.

The partition wall 8 has upper, intermediate and lower rows of generally round holes 13*a*, 13*b* and 13*c* defined therein with those rows being vertically spaced from each other. Each of the round holes 13*a* of the upper row has a diameter greater than the round holes 13*b* of the intermediate row, while each of the round holes 13*c* of the lower row has a diameter smaller than the round holes 13*b* of the intermediate row.

In the above-described construction, if a liquid refrigerant 7 is returned to the closed vessel 4 through the refrigerant suction pipe 10 during operation of the compressor, the liquid refrigerant 7 is most likely stored in the second oil sump 14*b* separated from the oil supply pipe 6 by the partition wall 8. Having passed through the oil supply pipe 6, the lubricating oil 5 is supplied to the compression mechanism 1 to lubricate it. After lubrication, the lubricating oil 5 passes through the oil return through-hole 9*a* and is returned to the first oil sump 14*a* in which the oil supply pipe 6 is positioned. As such, the compression mechanism 1 is supplied with a sufficient amount of lubricating oil 5, thus enhancing the reliability of the closed compressor.

Even when cold starting after a long-term stop, a larger quantity of lubricating oil 5 than liquid refrigerant 7 (contained in the second oil sump 14*b*) passes through the large-diameter round holes 13*a* of the upper row and is introduced into the oil supply pipe 6. This results in an increase in reliability of the closed compressor.

It is to be noted here that although in the above-described embodiments the partition wall 8 has been described as having vertically spaced three rows of generally round holes, each hole is not limited to a round one but may be of any other suitable configuration.

It is also to be noted that the partition wall 8 may have two vertically spaced rows of holes if each hole of the upper row has an area greater than the holes of the lower row.

It is further to be noted that although in the above-described embodiments the three rows of holes have been described as having different areas, they may have the same area. The reason for this is that even if the liquid refrigerant 7 is returned to the closed vessel 4 through the refrigerant suction pipe, the partition wall 8 prevents the liquid refrigerant 7 from being introduced into the oil supply pipe 6 until the level of the liquid refrigerant 7 outside the generally cylindrical partition wall 8 (FIG. 1) or within the second oil sump 14*b* (FIG. 3) becomes high enough to reach the holes of the lowermost row.

Figure 5:
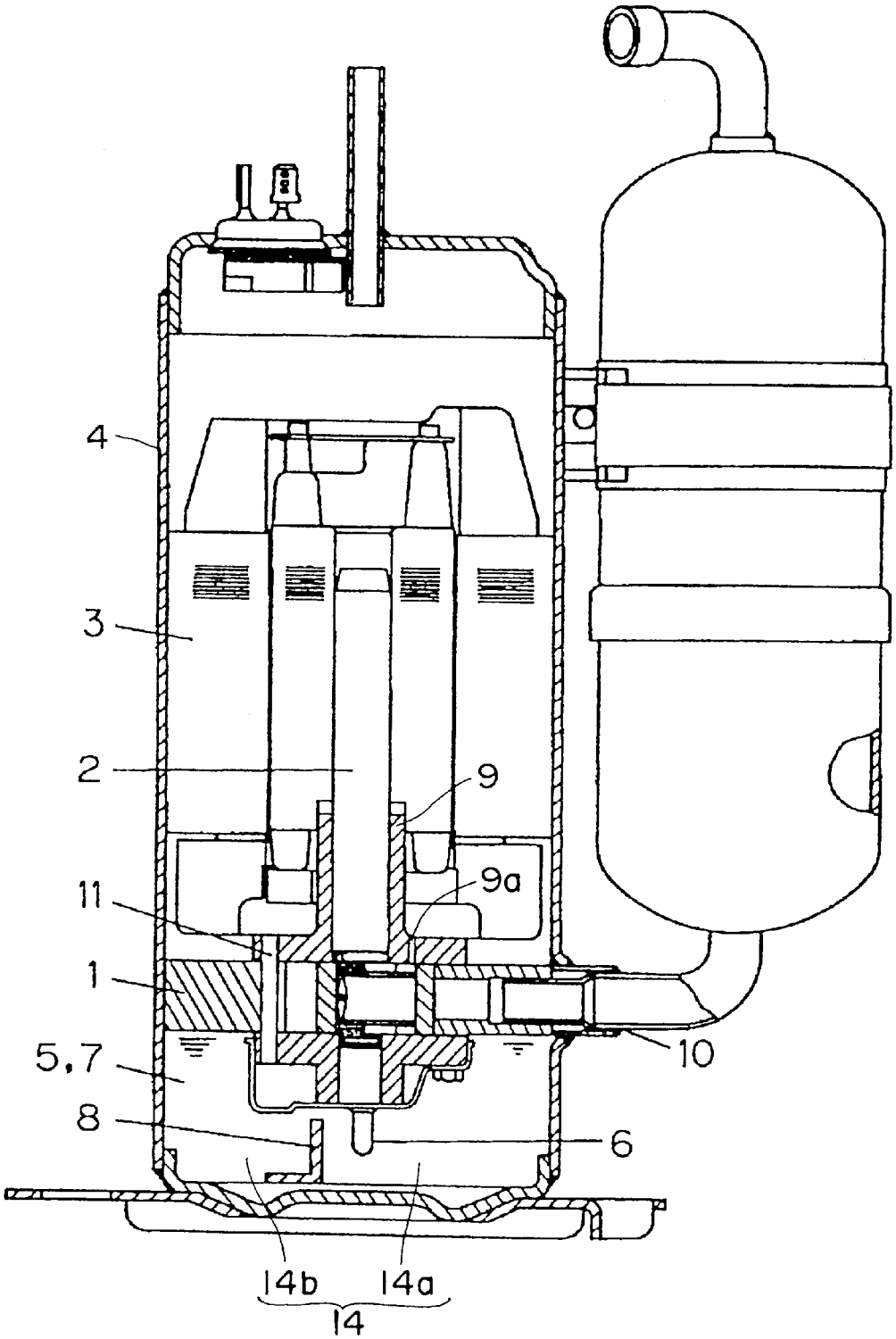
FIG. 5 is a view similar to FIG. 3, but including to a modification thereof.

FIG. 5 depicts a closed compressor having a construction somewhat similar to that of the closed compressor shown in FIG. 1. However, the closed compressor of FIG. 1 has a generally cylindrical partition wall 8 for radially partitioning the oil sump 14, while the closed compressor of FIG. 5 has a partition wall 8 for laterally partitioning a lower portion of the oil sump 14. In the closed compressor of FIG. 5, the lower portion of the oil sump 14 is partitioned by the partition wall 8 into a first portion 14*a*, in which the oil supply pipe 6 is positioned and above which an oil return through-hole 9*a* defined in a main frame 9 is positioned, and a second portion 14*b* above which a refrigerant discharge passage 11 defined in the compression mechanism 1 is positioned. The discharge pressure acts within the closed vessel 4.

In the above-described construction, if a liquid refrigerant 7 is introduced into the closed vessel 4 through the refrigerant suction pipe 10 during operation of the compressor, the liquid refrigerant 7 is compressed by the compression mechanism 1. The liquid refrigerant 7 thus compressed passes through the refrigerant discharge passage 11 and is most likely stored in the second portion 14*b* of the oil sump 14 and is separated from the oil supply pipe 6 by the partition wall 8. Thus, the reliability of the compressor is enhanced.

It is to be noted here that although the partition wall 8 is illustrated in FIG. 5 as having no holes, it may have a plurality of relatively small holes to allow the liquids to pass therethrough.

Figure 7:
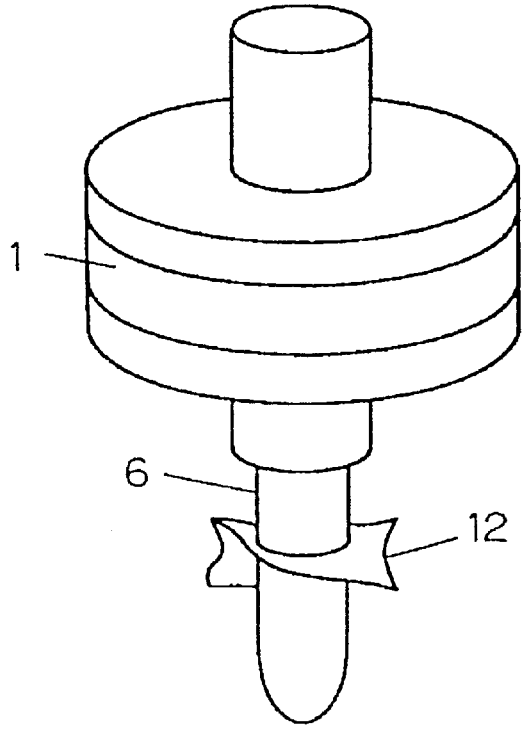
FIG. 7 is a perspective view of an agitating blade mounted in a lower portion of the closed compressor of FIG. 6.
Figure 6:
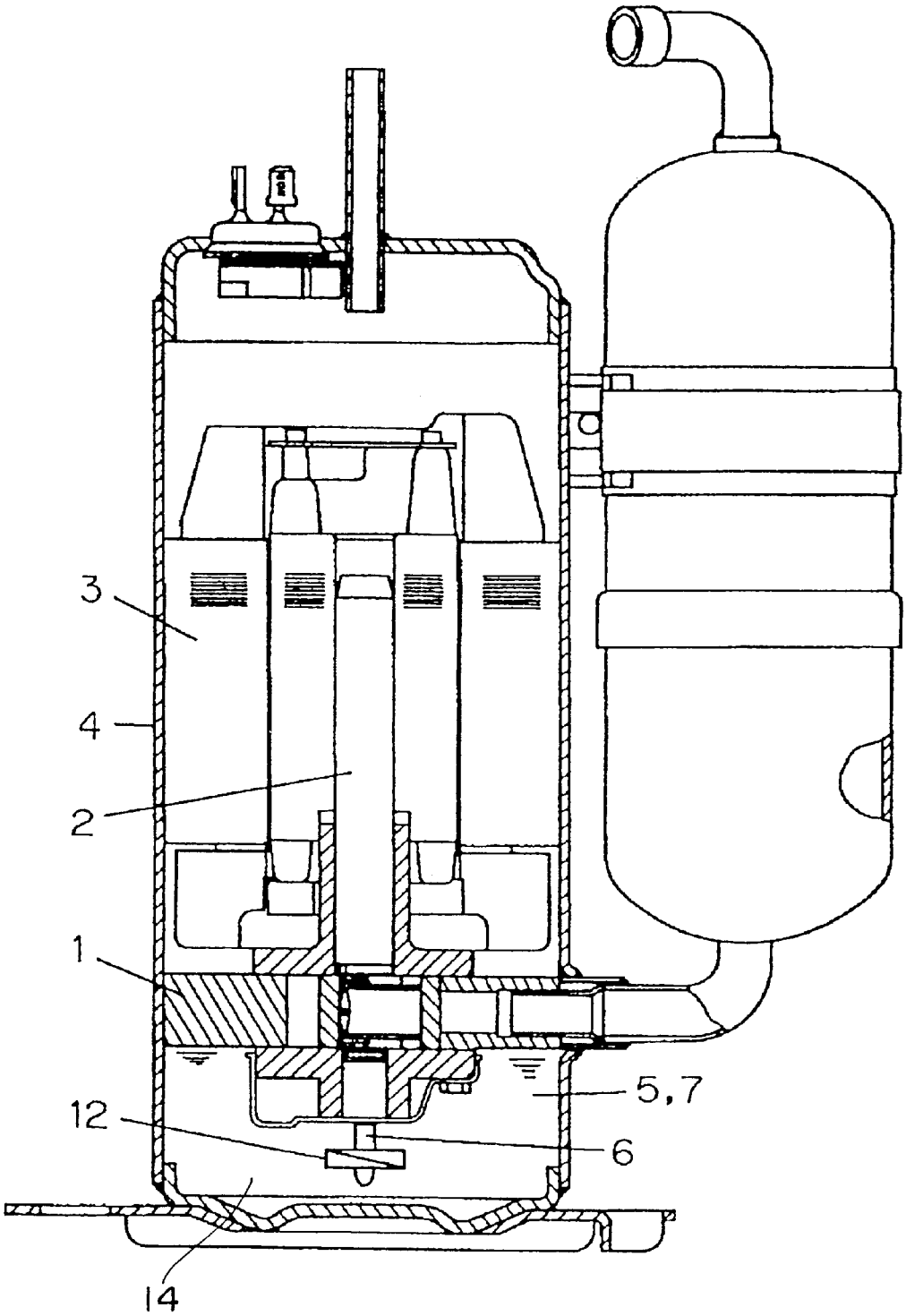
FIG. 6 is a sectional view of a closed compressor according to a third embodiment of the present invention.
Figure 8:
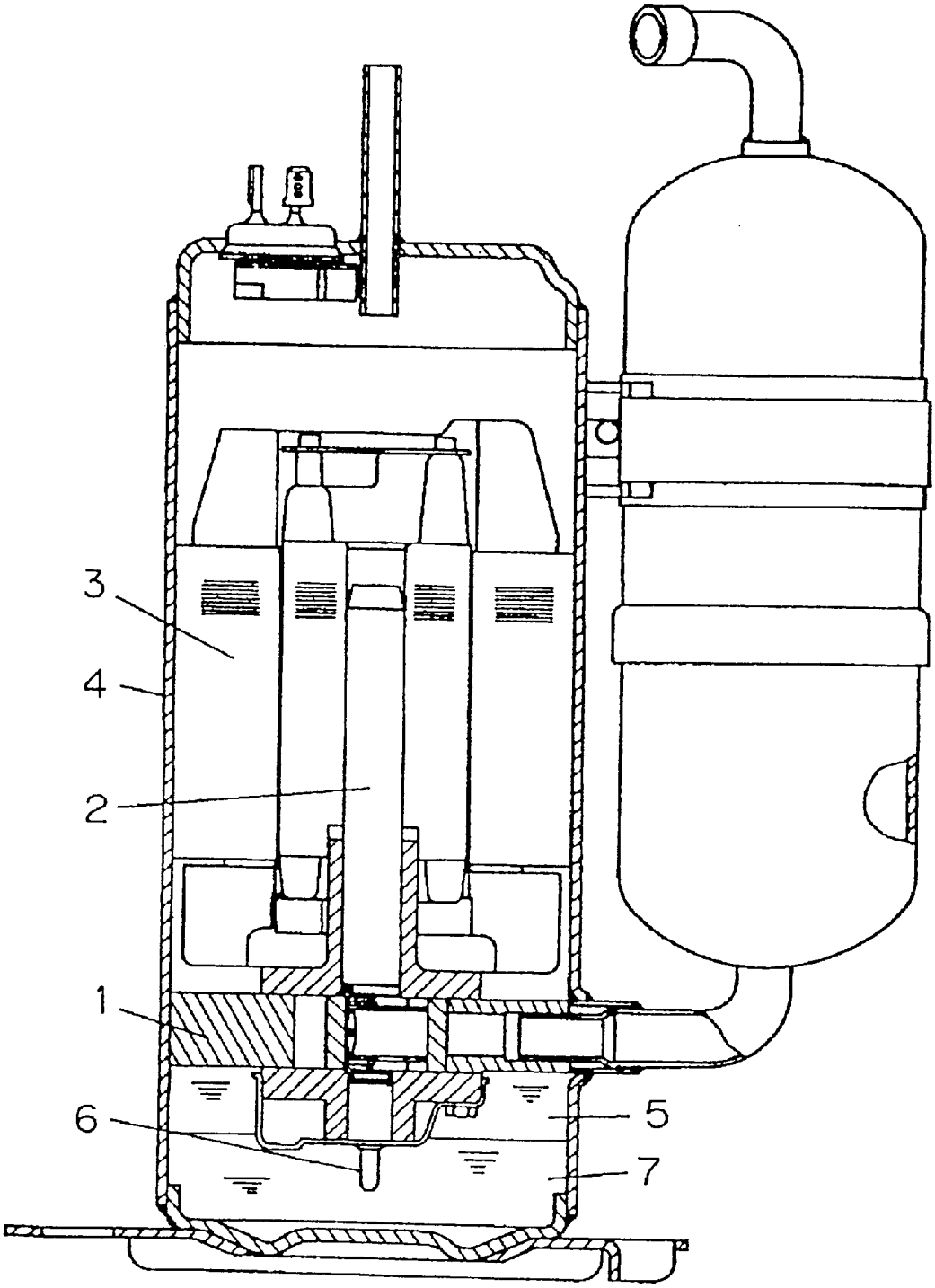
Fig. 8 PRIOR ART
FIG. 8 is a sectional view of a conventional closed compressor.

FIG. 6 depicts a closed compressor according to a third embodiment of the present invention. The closed compressor of FIG. 6 is of a construction somewhat similar to that of the closed compressor of FIG. 1. However, it differs from the latter in that the closed compressor of FIG. 6 has an agitating blade 12 secured to the oil supply pipe 6 for rotation together therewith, as shown in FIG. 7.

If a liquid refrigerant 7 and lubricating oil 5 are both contained in the oil sump 14 in a mixed fashion, the agitating blade 12 driven by the electric motor 3 agitates them and produces a centrifugal force which acts on both the liquids 5 and 7. As a result, the liquid refrigerant 7 having a specific gravity greater than the lubricating oil 5 is pressed against the side wall of the closed vessel 4, and the lubricating oil 5 is collected radially inward of the oil sump 14. Accordingly, the lubricating oil 5 is drawn into the oil supply pipe 6. Hence, even when the liquid refrigerant 7 is returned to the closed vessel 4 during operation of the compressor, the compression mechanism 1 is supplied with a sufficient amount of lubricating oil 5. Thus, the reliability of the compressor is enhanced.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A closed compressor comprising:

a closed vessel having an oil sump for accommodating refrigerant and lubricating oil incompatible with the refrigerant;

a compression mechanism accommodated in said closed vessel;

a rotary shaft connected to said compression mechanism;

an electric motor for rotating said rotary shaft to drive said compression mechanism;

an oil supply pipe connected to said compression mechanism by being secured to an end of said rotary shaft, said oil supply pipe extending into said oil sump so as to be capable of drawing the lubricating oil in said oil sump to said compression mechanism via said rotary shaft;

a generally cylindrical partition wall encircling said oil supply pipe and having a longitudinal axis and a plurality of holes, said plurality of holes including a plurality of rows of holes arranged to allow a larger quantity of the lubricating oil than the refrigerant to pass through said partition wall, said rows of holes being spaced apart with respect to said longitudinal axis, a higher row of holes having a larger area for fluid to pass through than a lower row of holes.

2. The closed compressor of claim 1, wherein said closed vessel has a bottom plate forming a portion of said oil sump, and wherein said partition wall is fixed to said bottom plate.

3. The closed compressor of claim 1, wherein said plurality of holes includes a first hole having a first area and a second hole having a second area, said first area being larger than said second area.

4. The closed compressor of claim 1, wherein said partition wall has a bottom end, and said plurality of rows of holes includes a lowermost row of holes, said lowermost row of holes being located above said bottom end of said partition wall.

5. A closed compressor comprising:

a closed vessel having an oil sump for accommodating refrigerant and lubricating oil incompatible with the refrigerant;

a compression mechanism accommodated in said closed vessel;

a rotary shaft connected to said compression mechanism;

an electric motor for rotating said rotary shaft to drive said compression mechanism;

an oil supply pipe connected to said compression mechanism by being secured to an end of said rotary shaft, said oil supply pipe extending into said oil sump so as to be capable of drawing the lubricating oil in said oil sump to said compression mechanism via said rotary shaft; and a generally cylindrical partition wall encircling said oil supply pipe and having a plurality of holes for allowing the lubricating oil to pass through said partition wall, said plurality of holes including a first row of holes and a second row of holes, wherein said first row and said second row are vertically spaced apart such that said first row is located above said second row, and wherein each of said holes of said first row has a larger area than each of said holes of said second row.

6. The closed compressor of claim 5, wherein said closed vessel has a bottom plate forming a portion of said oil sump, and wherein said partition wall is fixed to said bottom plate.

7. The closed compressor of claim 5, wherein said plurality of holes further includes a third row of holes, said third row and said second row being vertically spaced apart such that said second row is located above said third row, and wherein each of said holes of said second row has a larger area than each of said holes of said third row.

* * * * *